US007249696B2

(12) United States Patent
Peñalver Garcia

(10) Patent No.: US 7,249,696 B2
(45) Date of Patent: Jul. 31, 2007

(54) PNEUMATIC LIQUID-DISPENSING GUN

(75) Inventor: Jose Peñalver Garcia, Molina de Segura (ES)

(73) Assignee: Industrias Penalver, S.L., Molina de Segura (ES)

( * ) Notice: Subject to any disclaimer, the term of this patent is extended or adjusted under 35 U.S.C. 154(b) by 85 days.

(21) Appl. No.: 10/542,091

(22) PCT Filed: May 22, 2003

(86) PCT No.: PCT/ES03/00237

§ 371 (c)(1),
(2), (4) Date: Jul. 13, 2005

(87) PCT Pub. No.: WO2004/103571

PCT Pub. Date: Dec. 2, 2004

(65) Prior Publication Data

US 2006/0124672 A1 Jun. 15, 2006

(51) Int. Cl.
*B67D 3/00* (2006.01)

(52) U.S. Cl. ..... 222/504; 222/309; 222/518

(58) Field of Classification Search ..... 222/504–505, 222/509, 518, 388–389, 309, 334, 333, 559
See application file for complete search history.

(56) References Cited

U.S. PATENT DOCUMENTS 3,690,518 A * 9/1972 Baker et al. ..... 222/504
4,360,132 A * 11/1982 Vilagi et al. ..... 222/504
4,852,773 A * 8/1989 Standlick et al. ..... 222/504
4,953,756 A * 9/1990 Breault et al. ..... 222/309
5,261,610 A 11/1993 Waryu et al.
5,277,344 A * 1/1994 Jenkins ..... 222/504
5,573,146 A * 11/1996 Gardner ..... 222/309
5,875,922 A * 3/1999 Chastine et al. ..... 222/1
5,934,520 A * 8/1999 Byerly et al. ..... 222/504
5,934,521 A 8/1999 Yamada et al.
6,076,711 A * 6/2000 McGuffey ..... 222/504

FOREIGN PATENT DOCUMENTS

EP 0 437 112 A 7/1991

* cited by examiner

*Primary Examiner*—Frederick C. Nicolas
(74) *Attorney, Agent, or Firm*—Birch, Stewart, Kolasch & Birch, LLP

(57) ABSTRACT

A pneumatic, liquid-dispensing gun includes: a central body (1); a pneumatic body (2); a needle (10) having a guide (6) and a conical tip; a nozzle (3) fixed in place with a nut (4); a sealing bellows (5) concentric to the needle (10); a pneumatic rod (9); a flow regulator (8) having a graduated scale, serving as a vernier scale; a retainer joint (16); a safety spring (17); an element (7) into which the flow regulator (8) is screwed, which at the same time is locked in by a flange (12); four screws (11) which connect the central body (1), the pneumatic body (2) and the flange (12); O-rings (13) and (14) inserted between the central body (1) and the pneumatic body (2); and a dovetail (18) disposed in the central body (1) and which is used to install and adjust the gun in machines and other devices.

5 Claims, 2 Drawing Sheets

FIG.1
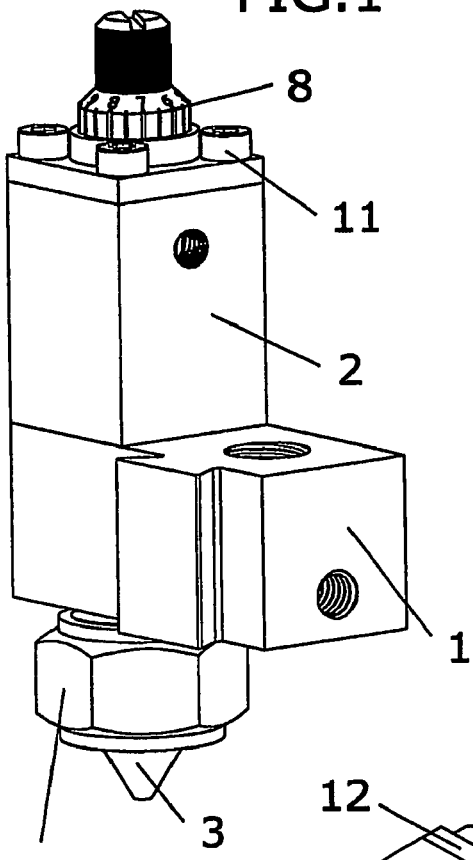
FIG.3
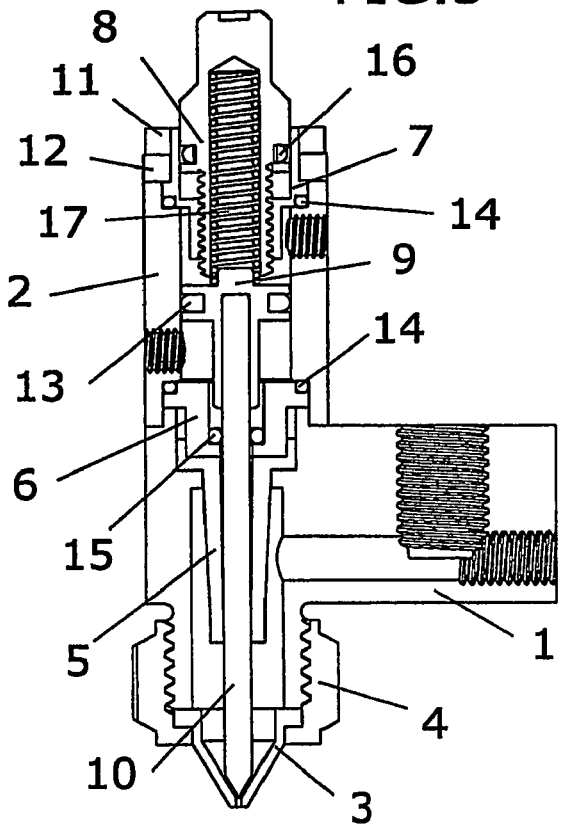
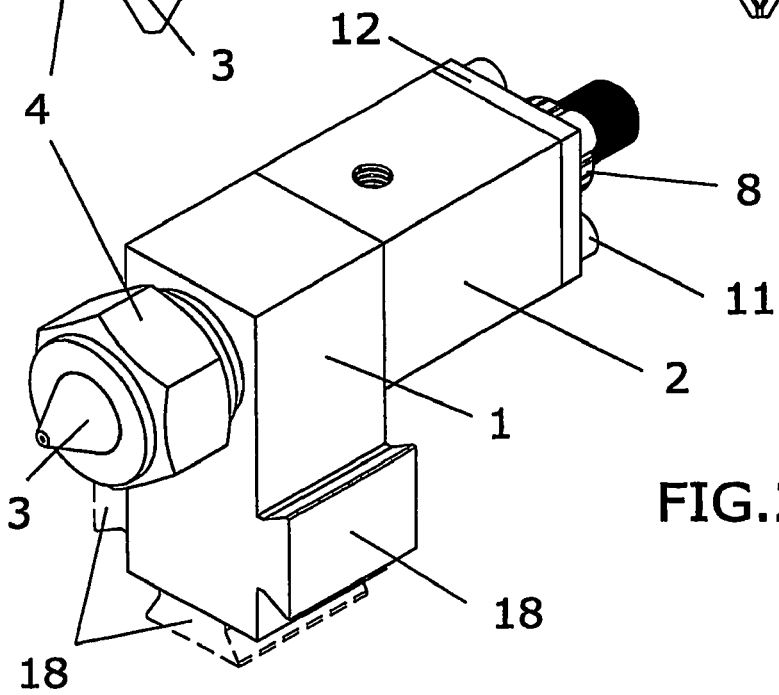
FIG.2

PNEUMATIC LIQUID-DISPENSING GUN

BACKGROUND OF THE INVENTION

1. Field of the Invention

The present invention relates to a pneumatically actuated gun for dispensing liquids, from among the various devices for applying gum used to seal containers.

This invention is applied to industrial processes in which speed of operation is a parameter as important as precision of the application, such as in packaging food products in metal tins.

The invention has a special construction of the gun that allows its installation in moving parts of machines or in industrial processes where the reduced weight and size are crucial.

2. Description of the Related Art

There are many guns or liquid application devices available in the market, but most are not designed for installation in moving parts, or are not pneumatically actuated, or are not as small and lightweight, or do not have the speed of operation of the invention described in what follows.

Installations for applying gum to steel or aluminium lids of tins using a sealant gum are of the type of Patent GB8308721, of W.R. Grace Ltd., of 14.10.82.

Patent EPO 0736332 by Rieck & Melzian GmbH is for an "Apparatus for applying gum to the edge portion of non-circular lids", with a fixed nozzle and a revolving lid, synchronising a toothed wheel with a toothed disc having the form of the lid, so that the number of teeth of the disc is a multiple of that of the wheel, as well as having two control cams that adapt the position of the disc to that of the wheel maintaining the teeth engaged, while the other cam ensures that the opening of the injection nozzle is on the midline of the sealing band being deposited next to the edge of the lid.

Lastly, and more directly related, Patent PCT ES 02/00271 of the present applicant relates to a "Cutter-gummer for the edges of non-circular metal lids of containers" that incorporates among other elements a large revolving plate and a diversity of workstations housed in said plate and provided with edge-cutting and gumming devices, diametrically opposite each other, that works with any shape of lid or base, adapting to their geometry by revolving the lids in the workstations, in which the gumming apparatus inclines the gun with total precision to follow the top edge of the copying cam by a follower arm in any angular position with respect to the plane of attachment to the arm, fixed for each type of lid, directing the stream of gum towards the base of the lid and by centrifugal force to the inner face of the edge wing and to a substantial portion of the lower segment of its rounding, without producing any spillage of gum to the outside due to overflowing.

The applicant is not aware of any registrations of pneumatically actuated guns in which the operational speed, application precision, weigh and size parameters are decisive.

DETAILED DESCRIPTION OF THE INVENTION

The present invention relates to a pneumatically actuated gun for dispensing liquids, generally for industrial processes, from among the various gumming devices used to seal containers preferably for food products and made of metal.

To obtain a compromise of the aforementioned parameters or characteristics, this device has a central body for passage of the liquid, a nozzle with an orifice for dispensing it and the pneumatic body.

The central body is made of a lightweight material and inside it is housed the pin that closes it, coupled to the inner cone of the nozzle. Mounted on said pin is the sealing bellows meant to separate the liquid application part from the pneumatic actuation part.

This sealing bellows is subjected to a compression force in the position where the pin is raised at the time of opening or applying the liquid, so that there is no relative movement between the union of said bellows and the pin, thereby preventing the friction that is characteristic of other sealing devices such as retainers, in which certain composite liquids may coagulate (such as liquid gum) under certain conditions of temperature, pressure and speed of application. The bellows is relaxed or in its original length when the pin is in the closed position.

The central body has a dovetail-shaped attachment system that allows a great versatility and positional regulation on the organ or element of the machine or the industrial process to be installed.

The nozzle has an inner cone on which the pin is coupled and a calibrated orifice, so that the desired amount of liquid is applied as a function of the diameter of said orifice and the elevation of the pin, the pressure and the physical properties of the liquid.

The pneumatic body is provided with a dual action cylinder in which the piston is mounted on the pin, so that the opening and closing of the pin is controlled by a high-speed pneumatic electrovalve. It is also provided with a spring for closure in the event of lack of air pressure. A graded screw limits the run of the pin and allows regulating the liquid flow.

DESCRIPTION OF THE DRAWINGS

The present descriptive memory is complemented by a set of drawings that illustrate the preferred, non-limiting example of the invention.

FIG. 1 is a perspective view of the outside of the gun.

FIG. 2 is a perspective view of the outside in various theoretical positions of the dovetail-shaped attachment of the gun in its three possible alternatives.

FIG. 3 is a longitudinal section of the gun showing the various elements comprising it.

DETAILED DESCRIPTION OF THE INVENTION

Figure 4:
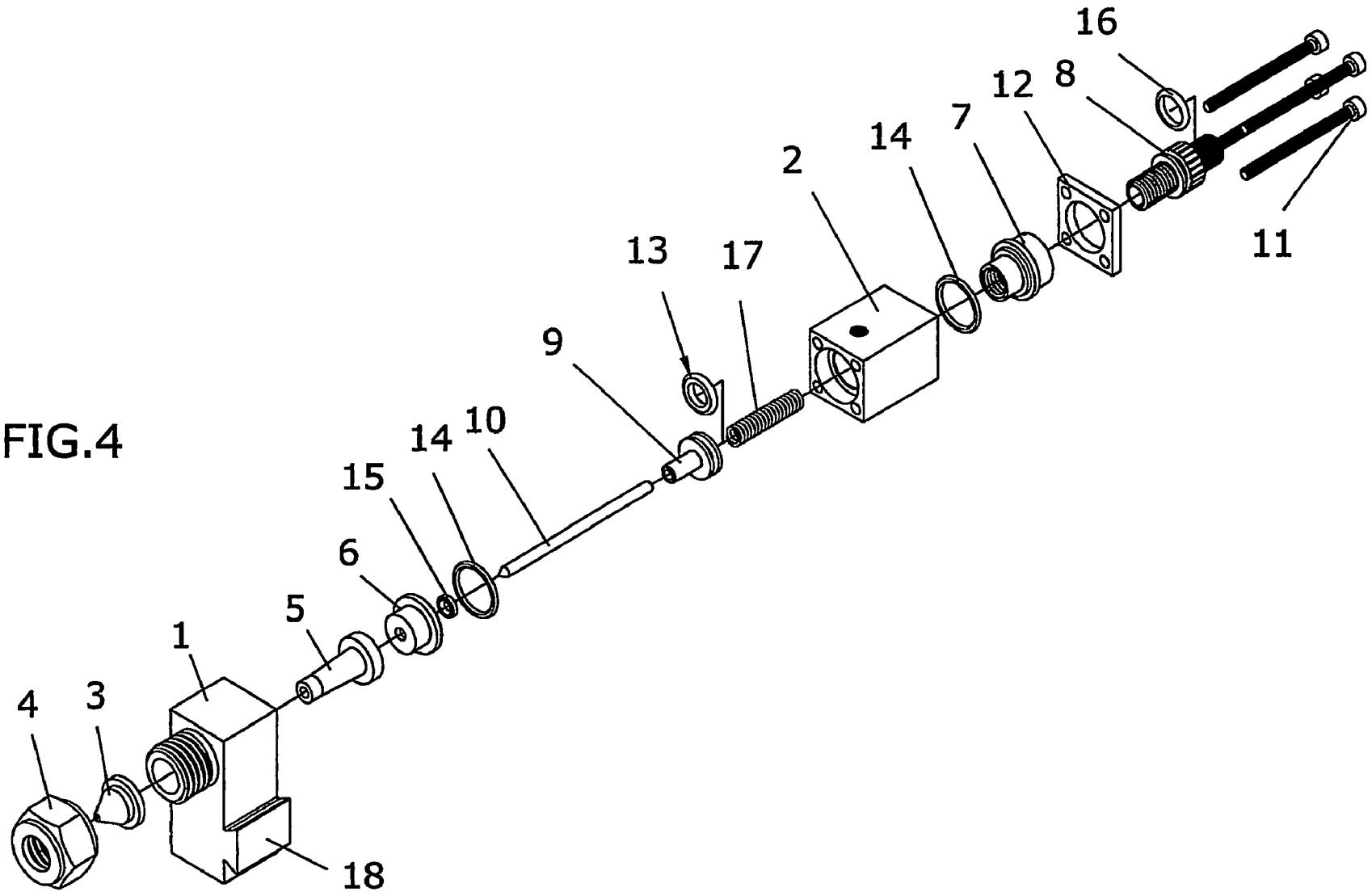
FIG. 4 is a perspective of the exploded view of the assembly of the elements that comprise the invention.

In view of the above discussion, the present invention relates to a pneumatically actuated gun for dispensing liquids, has a small size and low weight and a high speed of operation, functions that are provided by its compact design as can be inferred from the following description:

The exploded view of FIG. 4 shows a conical nozzle (3) for dispensing liquid coupled by an attachment nut (4) to a central body (1), prismatic in shape and made of a lightweight material.

The opening and closing operation, and therefore controlling the liquid flow in conditions of constant pressure and maintaining the physical properties of the gum to be impelled, is performed at a dual action pneumatic body (2), governed by the compressed air pressure differential on either side of the chamber defined by a pneumatic rod (9), a gasket (13) and the inside of this pneumatic body (2). A spring (17) inside the threaded extension of a flow regulator (8) that meets against the pneumatic rod (9) is meant to close a pin (10) in the event of lack of pneumatic pressure.

The opening and closing of the pin (10), which is provided with a guide (6) and a conical point, takes place on the inner cone of the nozzle (3), directly on the outlet orifice, with the resulting savings in space and preventing drying of the liquids and compounds due to prolonged contact with the air.

In the meantime, the tightness between the chamber or central body (1) and the pneumatic body (2), also prismatic and made of a lightweight material, is provided by O-rings (14) and (15) together with the bellows (5), made of an elastic material and disposed inside the central body (1) concentrically to the pin (10) and integrally joined to said pin by its bottom, being compressed as the pin rises and preventing any relative movement of the pin (10) and the bellows (5), thereby also preventing the friction in the retainers that is responsible for the coagulation, sedimentation or solidification of the liquids that occlude the orifice of the nozzle (3).

The pneumatic rod (9), with a small diameter that increases the response speed and reduces the size and weight of the pneumatic body (2), is integrally joined to the pin (10) and is operated by compressed air so that, depending on the pressure difference on either side of the chamber defined by said rod (9), the O-ring (13) and the inside of the pneumatic body (2), the pin (10) will rise or fall. The pneumatic part is preferably operated by a high-speed pneumatic electrovalve.

The upwards run of the pin is precisely adjusted and is limited by the flow regulator (8), partially housed in the body (2) that is threaded on an element (7) and that also acts as a calliper for the fine adjustment of the run of the pin (10). Meanwhile, the element (7) is blocked by a flange (12), and a gasket (16) provides resistance to rotations and prevents an accidental loosening of the regulator (8), which is threaded on the element (7) and reveals projecting beyond the body (2) a knurled cylindrical pin, for manual adjustment, followed by a graded circular ruler.

Finally, four M3×40 screws (11) joining the central body (1), the pneumatic body (2) and the flange (12) close the assembly as a whole, making the gun very easy to assemble and disassemble.

The gun is designed for a dovetail and clip attachment, allowing a simple installation and attachment to any organ or element of the industrial machine or device. A dovetail (18) is on the central body; FIG. 2 shows three possible locations for it depending on the needs of the application.

The essence of this invention is not altered by variations in the materials, shape, size and arrangement of its component elements, described in a non-limiting manner that should allow its reproduction by an expert.

The invention claimed is:

1. A pneumatic liquid-dispensing gun for dispensing liquids, comprising:

a central body and a pneumatic body having a prismatic shape and made of a lightweight material;

a pin with a guide and a conical point that rests on an inside of a nozzle closing an outlet orifice;

said nozzle being conical in shape and attached to the central body by a nut;

a sealing bellows made of an elastic material and concentrically mounted on the pin (10) inside the central body (1);

a pneumatic rod with a small diameter that increases the speed of response and reduces the size of the pneumatic body (2);

a flow regulator partly housed inside the pneumatic body, an exposed portion of the flow regulator that projects from the pneumatic body being provided with a scale for visually determining an amount of a run of the pin, and a knurled cylindrical part for rotating the flow regulator, the flow regulator acting as a calliper in a fine adjustment of the run, with resistance to rotation being provided by a gasket, the flow regulator further provided with a safety spring mounted on an inner diameter of the flow regulator to achieve closure in event of lack of external pneumatic pressure;

an element screwed onto the flow regulator and in turn blocked by a flange (12);

four screws joining the central body, the pneumatic body, and the flange, that facilitate assembly and disassembly of the gun;

O-rings providing tightness between the central body and the pneumatic body; and a dovetail provided on the central body.

2. The pneumatic liquid-dispensing gun according to claim 1, wherein, the pneumatic body has a dual action, an opening and closing operation is governed by a pressure differential of compressed air on either side of a chamber defined by the pneumatic rod, a gasket and the inside of the pneumatic body, as well as the spring closing the pin in the event of lack of external pneumatic pressure.

3. The pneumatic liquid-dispensing gun according to claim 1, wherein, the liquid flow regulator also controls its opening and flow in conditions of constant pressure and physical properties of the liquids.

4. The pneumatic liquid-dispensing gun according to claim 1, wherein, the sealing bellows has a trunco-conical shape and a bottom part thereof is integrally joined to the pin, the pin is compressed when said pin rises, preventing relative motion between a pin-bellows union and thereby preventing friction of retainers, and thus coagulation, sedimentation or solidification of sealing liquid, as well as occlusion of the nozzle orifice.

5. The pneumatic liquid-dispensing gun according to claim 2, wherein, the liquid flow regulator also controls its opening and flow in conditions of constant pressure and physical properties of the liquids.

* * * * *